United States Patent [19]

Bennett

[11] Patent Number: 4,714,160

[45] Date of Patent: Dec. 22, 1987

[54] DISPENSER OF ARTICLES

[75] Inventor: Robert Bennett, Easton, Conn.

[73] Assignee: RJS Industries Inc, Marlboro, N.J.

[21] Appl. No.: 922,329

[22] Filed: Oct. 23, 1986

[51] Int. Cl.[4] ..... B65D 85/24; A45D 40/20

[52] U.S. Cl. ..... 206/385; 206/104; 206/362; 206/473; 206/45.34

[58] Field of Search ..... 206/385, 45.34, 581, 206/472, 473, 443, 482, 483, 564, 104–120, 362, 362.4

[56] References Cited

U.S. PATENT DOCUMENTS

| | | | |
|---|---|---|---|
| 2,901,100 | 8/1959 | Mueller et al. | 206/564 |
| 3,666,087 | 5/1972 | Cooper | 206/45.34 |
| 4,304,330 | 12/1981 | Winkler et al. | 206/45.34 |
| 4,471,874 | 9/1984 | Morane | 206/385 |
| 4,545,486 | 10/1985 | Bostic | 206/45.34 |
| 4,648,505 | 3/1987 | Belmondo | 206/443 |

*Primary Examiner*—Stephen Marcus

[57] ABSTRACT

A dispenser has a horizontally elongated base with first and second flat surfaces. A plurality of spaced elongated rods are each secured at one end to the first surface. The opposite ends each have a coating. The rods extend perpendicular to the base and lie in a common plane. An elongated support member is disposed in a plane parallel to the common plane, is spaced from the articles, and is secured at one end to the base. A horizontally elongated plate parallel to the base and secured at one of the elongated edges to the other end of the member is disposed adjacent but spaced from the coated ends of the rods. First and second parallel elongated article support elements contact the rods and are secured to the member. These elements extend in a direction perpendicular to the direction of extension of the rods. The first element is disposed adjacent the one member end. The second element is disposed between the first element and the plate. A hollow transparent cover detachably engages the base and encloses the elements, plate, member, plate, support member and rods while being spaced from the rods.

5 Claims, 6 Drawing Figures

FIG. 1
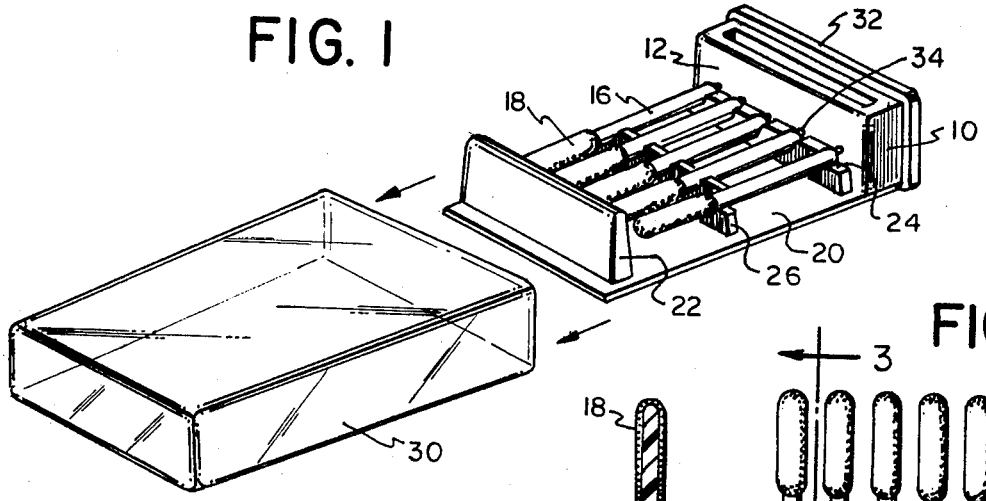
FIG. 2
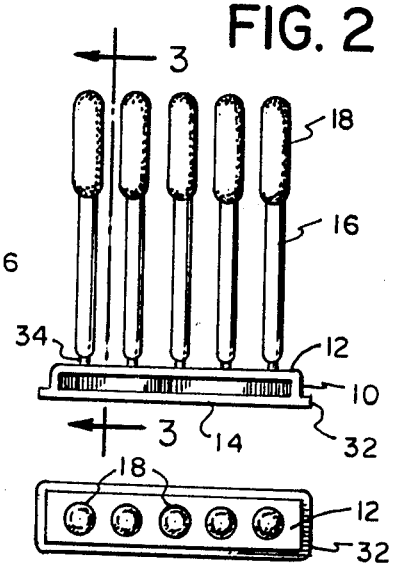
FIG. 3
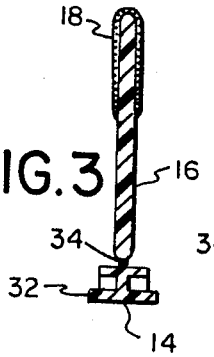
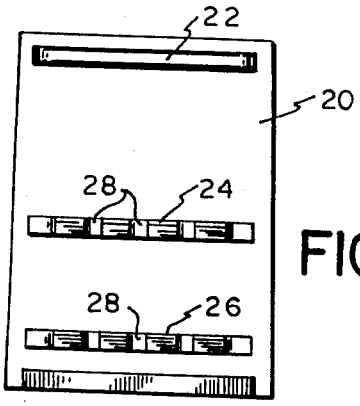
FIG. 5
FIG. 4
FIG. 6
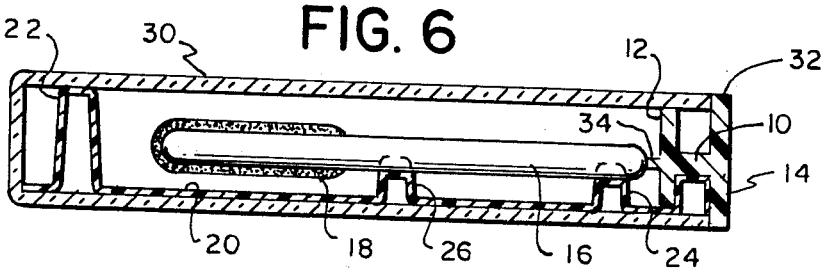

DISPENSER OF ARTICLES

BACKGROUND OF THE INVENTION

Potential users of cosmetic articles, as for example lipsticks, do not want to purchase articles which are unsatisfactory for the individual desired usage. For example, a lipstick color as displayed on the individual lip stick may appear to be satisfactory before application, but may be found unsatisfactory when actually applied to the lips. It is of course possible for a potential user to purchase a lipstick and throw it away after one unsatisfactory application, but such action is obviously costly and undesirable.

A primary object of the present invention is to provide a dispenser containing a plurality of articles such as plastic rods, each of which has a differently colored lipstick coating at one end, wherein each article can be used for a single application and then thrown away. In other words, this type of dispenser can be used to provide individual samples of lipsticks of different colors, whereby a potential user can test any lipstick color without appreciable expense. Indeed, the dispenser may be made available free of charge by the organization marketing the lipsticks.

SUMMARY OF THE INVENTION

A dispenser of articles, in accordance with the principles of the present invention, utilizes a horizontally elongated rectangular base having first and second opposite flat surfaces.

A plurality of elongated spaced apart articles are employed in the invention. Each article consists of an elongated rod having a coating at one end which is secured via an integral short thin prong on its opposite end to the first surface of the base. These articles lie in a common plane and extend in a common direction perpendicular to the base.

An elongaed support member is secured at one end to the base. The member is spaced from the articles and lies in a plane parallel to the common plane.

A horizontally elongated plate parallel to the base is secured at one of its elongated edges to the other end of the support member. The plate is disposed adjacent but is spaced from the coated ends of the plurality of articles.

First and second parallel elongated support elements are used to hold the articles securely in position. The first element is secured to the support member in a position adjacent the secured ends of the articles and extends in a direction perpendicular to the common direction. The second element is secured to the member in a position intermediate the first element and the plate. Each element can contain a like plurality of straight grooves which extend in the common direction and are disposed side by side. Each groove in the first element is aligned with a corresponding groove in the second element to form an aligned groove pair. Each article engages a corresponding one of the aligned groove pairs.

A transparent hollow cover detachably engages the base, leaving the second surface of the base exposed. When the cover is in position, the cover encloses the elements, the plate, the support member and the articles without touching the articles.

In use, the potential user removes the cover, selects one of the articles and pulls it out of the grooves, pivoting the selected article about the prong which is attached to the base. This end then breaks away from the base whereby the user can apply the coating on the selected article for inspection for future use in the manner previously discussed.

The foregoing and other objects and advantages of the invention will either be explained or will become apparent to those skilled in the art when this specification is read in conjunction with the accompanying drawings.

BRIEF DESCRIPTION OF THE DRAWINGS

FIG. 1 is an exploded view in perspective of one embodiment of the invention.

FIG. 2 is a side view of the base with articles attached.

FIG. 3 is a view taken along line 3—3 in FIG. 2.

FIG. 4 is a top view of the structure shown in FIG. 2.

FIG. 5 is a side view of the support member with attached supporting elements.

FIG. 6 is a side view in cross section of the embodiment of FIG. 1 shown in closed position.

DETAILED DESCRIPTION OF PREFERRED EMBODIMENTS

Referring now to FIGS. 1-6, a plastic horizontally elongated rectangular base 10 has first and second opposite flat surfaces 12 and 14. A plurality of spaced elongated rods 16 are each secured at one end by an integral short thin prong 34 to surface 12 and extend outward in a common direction at right angles to the base 10. These rods lie in a common plane. The opposite end of each rod has a coating 18. These coatings can be differently colored lipstick materials or if desired can be differently colored cosmetic powders or other materials. The rods and base are normally molded in one piece and the coatings can be applied to the unsecured ends of the rods.

An elongated plastic support member 20 lies in a plane parallel to the common plane and is secured at one end to the base. The member 20 is spaced from the rods. A horizontally elongated plate 22 which is parallel to the base is secured at one of its elongated edges to the other end of the member. The plate is disposed adjacent, but is spaced from, the coated ends of the articles.

First and second elongated parallel support elements 24 and 26 are each secured to the member 20. Element 24 is secured to the member adjacent the end of the member secured to the base and extends in a direction perpendicular to the direction of extension of the rods. Element 26 is secured to the member in a position intermediate element 24 and plate 22. Each element has a plurality equal in number to the number of rods of straight parallel grooves 28 which are disposed side by side and extend in the common direction. Each groove in one element is aligned with the corresponding groove in the other element to form an aligned groove pair. Each rod engages detachably a corresponding aligned groove pair. Typically, the support member, the plate and the elements are molded in one plastic piece before being secured to the base.

A transparent plastic hollow cover 30 open at one end detachably engages the base. The base has an outwardly projecting lip 32 disposed adjacent surface 14 and the open end of the cover engages lip 32 to enclose the elements, the plate, the support member and the rods, with surface 14 of the base being exposed. The cover, when engaging the base, is spaced from the rods.

While preferred embodiments of the invention have been described above, it will be apparent to those skilled in the art that numerous modifications thereof can be made without departing from the invention as defined by the scope of the claims that follow.

What is claimed is:

1. A dispenser of articles comprising:

a horizontally elongated rectangular base having first and second opposite flat surfaces;

a plurality of elongated spaced articles, each article consisting of an elongated rod having a coating on one end and secured at the other end by an integral short thin prong to the first base surface, said articles extending in a common direction perpendicular to the base and lying in a common plane;

an elongated support member lying in a plane parallel to said common plane and having two opposite ends, and being secured at one end to said base, said member being spaced from said articles;

a horizontally elongated plate parallel to said base and secured at one of its elongated edges to the other end of the member, said plate being disposed remote from said base and adjacent but spaced from the coated end of each of the articles;

first and second parallel elongated article support elements, the first element being secured to said member in a position adjacent said one member end and extending in a direction perpendicular to said common direction, the second element being secured to said member in a position intermediate the first element and the plate, each article contacting both of the elements; and a transparent hollow cover detachably engaging the base with the second base surface being exposed to enclose the elements, plate, support member, and articles, the cover, when engaging the base, being spaced from the articles.

2. The dispenser of claim 1 wherein each element has a like plurality of straight spaced apart grooves disposed side by side and extending in the common direction, each groove in one element being aligned with the corresponding groove in the other element to form an aligned groove pair, each article engaging a corresponding one of the aligned groove pairs.

3. The dispenser of claim 2 wherein the coatings are colored, each rod having a coating of a different color.

4. The dispenser of claim 3 wherein said coatings are lipstick coatings.

5. The dispenser of claim 4 wherein the base has adjacent the exposed surface an outwardly extending lip, said cover having an open end which engages said lip when the cover engages the base.

* * * * *